US005141429A

United States Patent [19]

Menninga

[11] Patent Number: 5,141,429

[45] Date of Patent: Aug. 25, 1992

[54] DEVICE FOR WORKING A SUPPLY OF CLAY TO MOULDINGS ADAPTED FOR FIRING HAND MOULD BRICKS

[75] Inventor: H. Menninga, Sneek, Netherlands

[73] Assignee: Beheermaatschappij De Boer Nijmegen B.V., Nijmegen, Netherlands

[21] Appl. No.: 549,620

[22] Filed: Jul. 9, 1990

[30] Foreign Application Priority Data

Jul. 10, 1989 [NL] Netherlands ..... 8901769

[51] Int. Cl.[5] ..... B28B 7/08; B28B 13/06

[52] U.S. Cl. ..... 425/439; 249/137; 425/99; 425/361; 425/452

[58] Field of Search ..... 425/99, 100, 161, 216, 425/217, 219, 220, 227, 253-255, 256, 261, 297, 315, 361, 439, 452; 249/137

[56] References Cited

U.S. PATENT DOCUMENTS

| | | | |
|---|---|---|---|
| 1,335,071 | 3/1920 | Moussette | 425/361 |
| 1,476,496 | 12/1923 | Davis | 425/439 |
| 1,548,474 | 8/1925 | Miller | 425/439 |
| 1,659,987 | 2/1928 | Benson et al. | 425/439 |
| 2,168,146 | 8/1939 | Wilson | 425/439 |
| 4,019,848 | 4/1977 | Balhorn | 425/254 |

FOREIGN PATENT DOCUMENTS 161832 10/1979 Netherlands .

*Primary Examiner*—Jay H. Woo
*Assistant Examiner*—James P. Mackey
*Attorney, Agent, or Firm*—Bauer & Schaffer

[57] ABSTRACT

An endless conveyor having a plurality of molding tray supports is mounted on an intermittently indexing turntable. A press of the type adapted to form the clay into lumps deposits these lumps into molding trays on the conveyor, and thereafter the trays pass successively through a series of stations where the loaded trays are trimmed, where the loaded trays are tilted, and where the moldings are dropped onto carrying pallets and stations for washing, drying, and sanding of the empty trays and a station for tilting the molding trays back to the filling position. The tray supports are tiltably mounted about radial axes to enable tilting of the trays and a device for supplying the pallets for the empty trays and for the discharge of the pallets loaded with moldings extends diametrically underneath the turntable adjacent the unloading station.

3 Claims, 2 Drawing Sheets

DEVICE FOR WORKING A SUPPLY OF CLAY TO MOULDINGS ADAPTED FOR FIRING HAND MOULD BRICKS

BACKGROUND OF THE INVENTION

The invention relates to apparatus for forming clay blocks adapted for subsequently firing into the hand mold bricks.

Apparatus are known where molding trays with multiple molding cavities are placed on a conveyor belt transversely to the conveying direction and are mutually pivotally coupled so as to form the upper and lower run of the belt with the two end portions of the belt passing around guide sheaves. Devices of this type are adapted for high production rates, i.e. many thousands of bricks per hour.

The present invention aims at providing apparatus which is particularly suitable for low production rates, i.e. a few thousand bricks per hour, and which allows the production to be quickly and easily changed to form moldings of different shape or size. With the well known device such changes are very difficult to make as it would involve the changing of many dozens of molding trays.

SUMMARY OF THE INVENTION

The present invention is applied to an apparatus including an endless conveyor on which are mounted a succession of molding trays. A press adapted to form clay into lumps and to deposit these lumps as blocks into the molding trays. The conveyor is mounted for intermittent movement to pass under the press, thereafter indexing successively past a device for trimming the loaded tray, a station where the loaded trays are tilted, a discharge station where the blocks are dropped from the molding trays onto carrying pallets, a station for washing, drying and sanding of the empty molding trays and a station for tilting the molding trays back to the filling position. The conveyor is formed as a turntable having molding tray supports which are tiltably mounted about radial axes so as to invert the molding trays upon reaching the discharge station. The invention also provides a device for supplying the empty tray carrying pallets and for removing the pallets loaded with blocks, a path extending in a path diametrically underneath the turntable between the loading and discharge stations.

With such an arrangement, a relatively small number of molding trays will suffice. The diametrical positioning of the supply and discharge device for the pallets enables the number of molding tray positions which is needed for the various processing steps such as the filling, trimming, tilting, unloading, washing, drying, sanding, and returning to be kept to a minimum. Such a small number of molding trays may be replaced with other trays within a short period of time. Furthermore, the arrangement according to the invention results in a compact assembly of the composing parts, taking relatively little space.

It is to be noted that the use of a turntable for the manufacture of bricks is known per se. With the well known construction, however, the manufacture of an essentially different type of brick, i.e. a so-called "wassserstrich" brick, is involved. In that case the turntable is provided with a number of holes adapted to the desired brick shape, which, while the turntable is rotating, are successively loaded by means of a press provided thereabove. The turntable passes in contact and over a fixed and wetted substrate until the station is reached where the substrate is interrupted so as to allow an overhead ejector to discharge the moldings through the respective holds and substrate onto a pallet.

Also with the well-known construction, a rather small number of press hole positions (to be compared with the number of molding tray positions with the device according to the present invention) is involved. With the well-known device, however, no position or space is provided for the additional steps which have to be carried out when making molding for bricks having a hand mold structure. Moreover, with the well-known device the supply and discharge of the pallets for the moldings extends tangentially with respect to the turntable. According to the present invention, by employing the diametrical arrangement for pallet feed, at least two fewer molding tray positions are required in comparison with a tangential arrangement as used in the well-known device.

The invention will hereinafter be further described by way of example with reference to the drawing.

DESCRIPTION OF THE INVENTION

Figure 1:
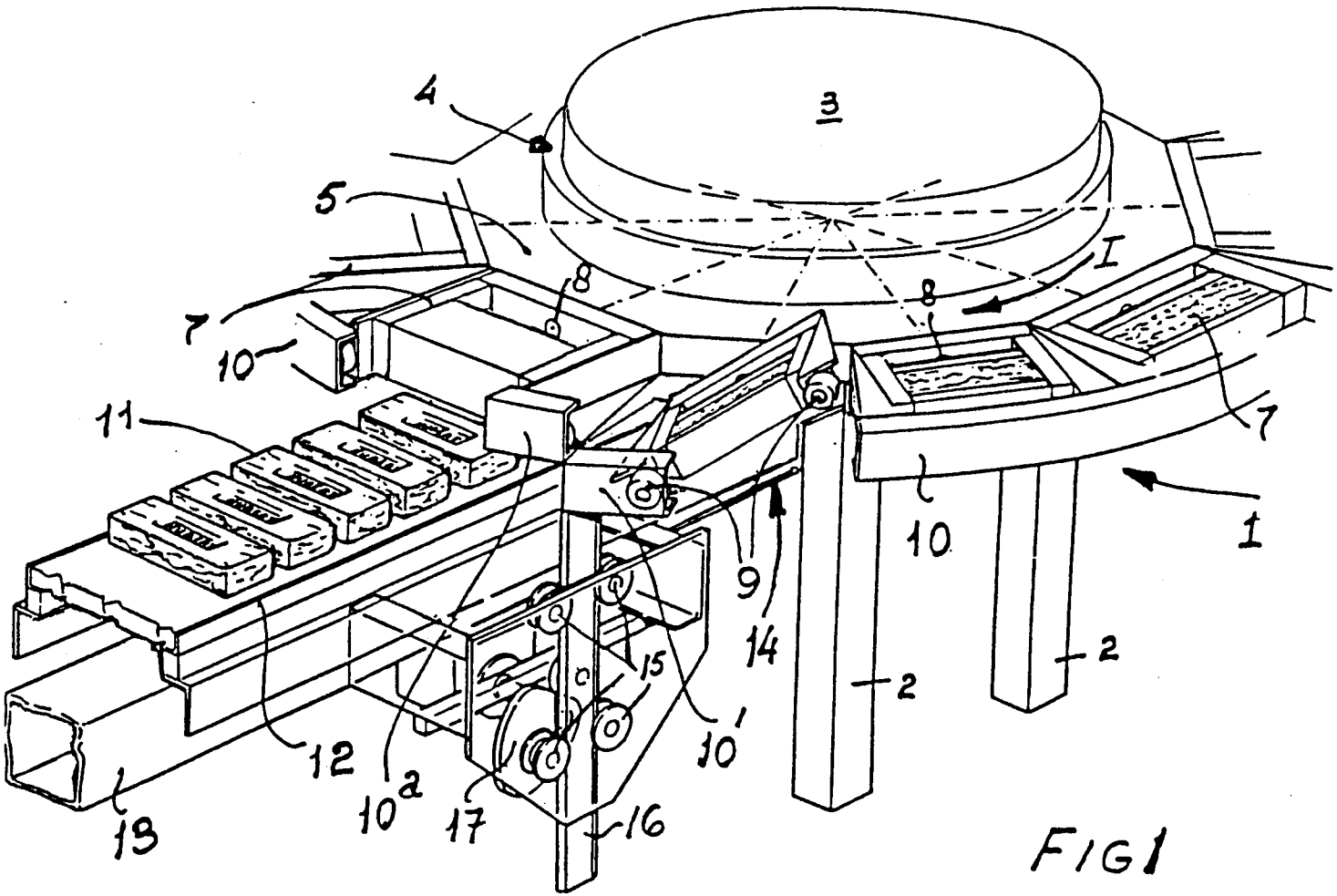
FIG. 1 is a perspective view of a portion of the device according to the invention, in which the diametrical position of the pallets loaded with molding blocks at the discharge station is shown as is the mechanism for the tilting of the molding trays.
Figure 2:
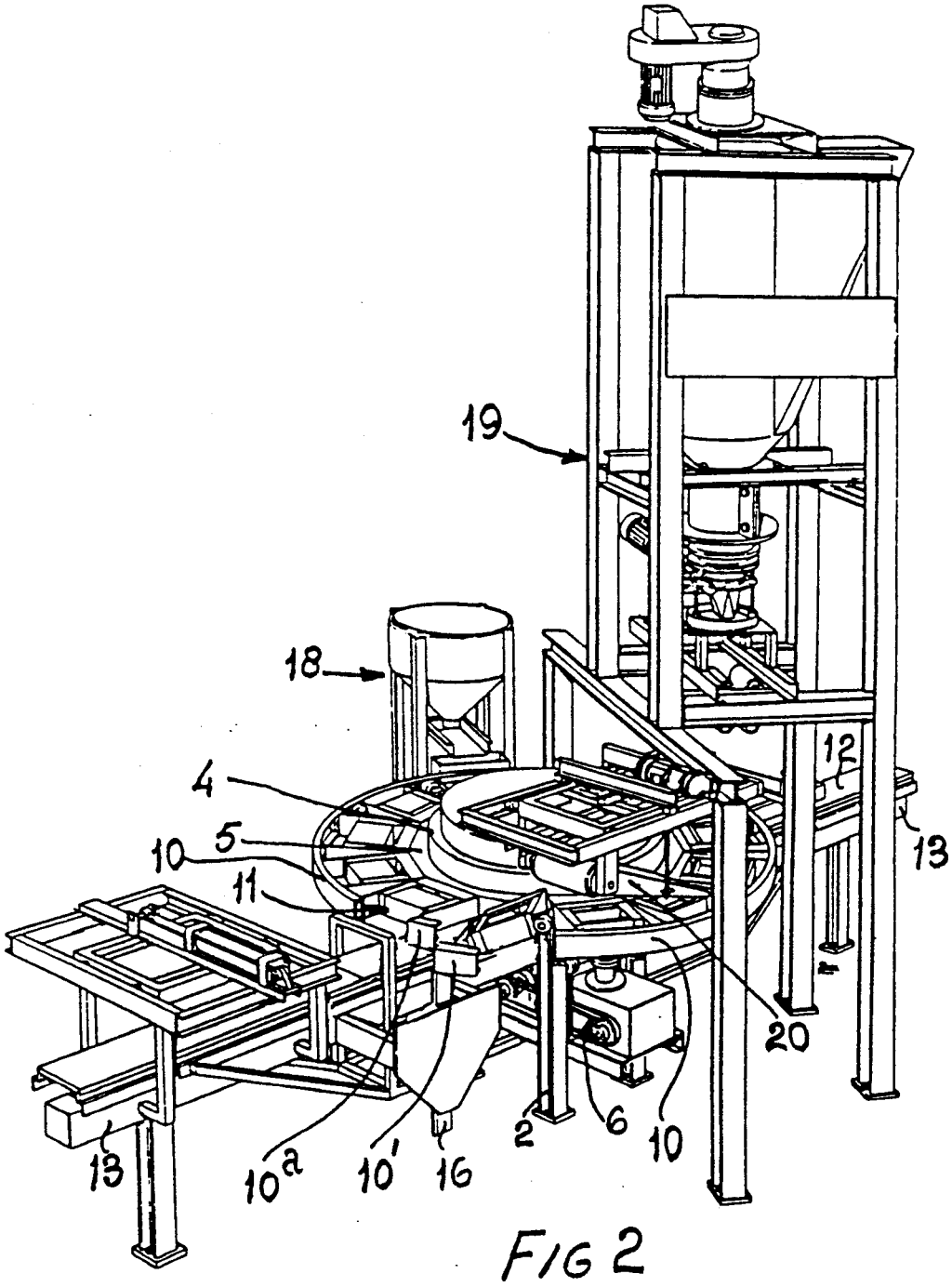
FIG. 2 is a perspective view on a smaller scale of the complete device.

As seen in FIGS. 1 and 2, the apparatus comprises a turntable 1 surrounded by a mounting ring 4 which is supported by legs 2 and which is covered by a removable cove 3. A supporting ring 5 is rotatbaly suspended about the mounting ring 4. The supporting ring 5 is toothed along its inner circumference (not shown), with teeth meshing with a drive gear, the rotation of which is taken from a central drive motor via a manifold-gear 6 (see FIG. 2). Spaced about the outer circumference of the support ring 5 are a plurality of molding tray supports 7. The molding tray supports 7 are pivotably mounted to the supporting ring 5 about axles 8 and are provided with a pair of rollers 9 at each of their outer circumferential corners. The rollers 9 run along within a guide rail 10 extending along the outer circumference of the turntable 1 so as to normally hold the molding tray supports 7 in their horizontal position. The guide rail 10 is locally interrupted at a station, indicated by the numeral 14, for a purpose which will be hereinafter further described.

The turntable (i.e. the supporting ring 5) is moved stepwise in the direction of the arrow A by the manifold-gear 6 via the drive gear (not shown). The turntable defines in the illustrated example twelve fixed circumferential positions between which the molding tray supports 7 are successively indexed. The turntable is kept stationary after each rotation step for a period of approximately one second, while the stepwise displacement takes place in approximately two seconds. As seen in the drawings, each of the twelve circumferential positions accommodates a molding tray support in which is received a molding tray.

Located beyond the station 14, where the rail is interrupted, in the direction of rotation is a discharge station 11. At this station the mounting tray supports 7 are turned upside down so that the respective molding tray has its filling opening directed downwardly to discharge the clay molding onto a pallet 12 supplied underneath. A sill 13 extending diametrically under the turntable is adapted to supply empty pallets 12 from the diametrically opposite side (from the right as seen in FIG. 2).

The respective molding tray supports 7 are tilted in a quick manner at the position 14 so that each molding tray will enter into the discharge station 11 in a substantially horizontal (but inverted) position and will be prevented from contacting the pallet 12, which on that moment takes a slightly elevated position in order to subsequently receive the mold.

In order to fulfill the latter condition, the guide rail 10 is cut at each end of the arc length defined by the station 14, and its rear portion is removed, leaving a gap in the rail 10. The forward remaining section 10' is mounted for vertical movement on a rod 16. In this condition, upon indexing of the turntable the rearward roller 9 of the molding tray support in the station 14 is not supported, whereas the forward roller 9 lodges in the vertically movable rail section 10'. The movable rail section 10' mounted on the upper end of the rod 16 which is vertically guided between rollers 15 is movable downwardly and upwardly through a cam 17. The movement of the cam is timed relative to the drive of the turntable 1 in such a way, that immediately after the molding tray support in station 14 has come to a standstill the rod 16 will be moved downwardly, whereby the forward roller 9 of the molding tray support in station 14 is taken along. This causes the molding tray support to tilt about the axle 8 to a substantially vertical position. In order to cause the molding tray support to tilt further into the horizontal inverted position and pass into the discharge station 11, the next displacement step of the turntable is initiated at the moment that the rod 16 arrives at its lowest position. This movement of the turntable in the direction of the discharge station 11 causes the rotational axis of the axle 8 of the respective molding tray support to move beyond the axis of the forward roller 9. This permits the molding tray support to continue tilting, so that the initially rearward roller 9 will become positioned forwardly and in front of the entrance of the fixed guide rail section 10*a*. Simultaneously, the initially forward roller 9 leaves the movable rail section 10' in a rearward direction. Thereupon the rod 16 is quickly returned to its upper position, in which the guide rail section 10' and the fixed guide rail 10 will be in line again.

Following the discharge station 11, there are provided four indexing positions in which the respective molding tray supports 7 keep their invertive conditions so that flushing, washing, drying, and sanding of the emptied molding trays respectively may be carried out (the sanding station is indicated at 18).

Upon leaving the sanding station 18, the molding tray supports are returned into the filling position in order to be loaded again with a lump of clay by means of a loading press 19. The press 19 is of a well-known type disclosed in Netherlands Patent No. NL 161832, in which presanded lumps of clay are cut from a continuous strand and deposited in the respective molding trays. The excess of clay projecting beyond the upper edge of the molding tray, the so-called "klad" is subsequently trimmed off in a well-known manner by means of a cutting wire and a trimming belt 20 mounted adjacent the latter as the turntable rotates.

I claim:

1. In apparatus for forming molded blocks for creating bricks, having a plurality of molding trays mounted on an endless conveyor, said conveyor moving in a path to carry said molding trays successively into operative alignment with at least a tray loading station and a tray discharge station, the improvement wherein the conveyor comprises a turntable with means for indexing said turntable about a central axis thereof and arranged so that the loading and discharge stations are diametrically opposed to each other, said turntable having a plurality of molding tray supports, each adapted to a hold a molding tray, said tray supports being uniformly spaced about the circumference of said turntable and pivotally mounted on said turntable so that each of the tray supports is adapted to rotate about a radially extending axis, each of said supports having leading and trailing guiding rollers positioned at outer corners of said supports, the apparatus further comprising a circular guide rail on which said guiding roller rest located radially exteriorly of said supports, said guide rail being interrupted along a portion of its length in advance of said discharge station to define a tray support tilting station, and means for engaging the leading guiding roller of each respective tray support at said tilting station to vertically move said leading guiding roller downwardly from the plane of said turntable to thereby tilt and invert said respective tray support to cause the block within the associated tray to be discharged at said discharge station.

2. The apparatus according to claim 1, wherein said means for engaging the leading guiding roller of said respective tray support comprises a guide rail section located at said tilting station and a vertical rod reciprocating said guide rail section in cooperation with the indexing of said turntable to swing said respective tray support about its radially extending axis.

3. The apparatus according to claim 1, including a pallet movably mounted below said turntable between said loading and discharge stations for delivering trays to said loading station and for removing blocks discharged from said discharge station.

* * * * *